US008407827B1

(12) United States Patent
Friedman et al.

(10) Patent No.: US 8,407,827 B1
(45) Date of Patent: Apr. 2, 2013

(54) SPATIALLY REACTIVE WATER SYSTEM

(76) Inventors: Adam Michael Friedman, Santa Monica, CA (US); Tyler Adams, Santa Monica, CA (US)

( * ) Notice: Subject to any disclaimer, the term of this patent is extended or adjusted under 35 U.S.C. 154(b) by 868 days.

(21) Appl. No.: 12/498,154

(22) Filed: Jul. 6, 2009

(51) Int. Cl.
*E03C 1/05* (2006.01)

(52) U.S. Cl. ..... 4/623

(58) Field of Classification Search ..... 4/623; 137/1; 251/129.04
See application file for complete search history.

(56) References Cited

U.S. PATENT DOCUMENTS

| | | | | |
|---|---|---|---|---|
| 3,556,146 | A | 1/1971 | Groen | |
| 4,402,095 | A | 9/1983 | Pepper | |
| 4,788,998 | A * | 12/1988 | Pepper et al. | 137/1 |
| 4,984,314 | A * | 1/1991 | Weigert | 4/663 |
| 5,085,399 | A | 2/1992 | Tsutsui et al. | |
| 5,549,273 | A | 8/1996 | Aharon | |
| 5,570,869 | A * | 11/1996 | Diaz et al. | 251/129.04 |
| 5,868,311 | A * | 2/1999 | Cretu-Petra | 236/12.12 |
| 5,875,257 | A | 2/1999 | Marrin et al. | |
| 5,966,753 | A * | 10/1999 | Gauthier et al. | 4/623 |
| 6,059,192 | A * | 5/2000 | Zosimadis | 236/12.12 |
| 6,236,317 | B1 * | 5/2001 | Cohen et al. | 340/573.1 |
| 6,340,032 | B1 * | 1/2002 | Zosimadis | 137/552 |
| 6,426,701 | B1 * | 7/2002 | Levy et al. | 340/573.1 |
| RE37,888 | E * | 10/2002 | Cretu-Petra | 236/12.12 |
| 6,513,787 | B1 * | 2/2003 | Jeromson et al. | 251/129.04 |
| 7,174,577 | B2 * | 2/2007 | Jost et al. | 4/623 |
| 7,731,154 | B2 * | 6/2010 | Parsons et al. | 251/129.04 |
| 7,766,026 | B2 * | 8/2010 | Boey | 137/1 |
| RE42,005 | E * | 12/2010 | Jost et al. | 4/623 |
| 7,921,480 | B2 * | 4/2011 | Parsons et al. | 4/313 |
| 8,028,355 | B2 * | 10/2011 | Reeder et al. | 4/623 |
| 8,162,236 | B2 * | 4/2012 | Rodenbeck et al. | 239/390 |

FOREIGN PATENT DOCUMENTS

| | | |
|---|---|---|
| JP | 3107682 | 5/1991 |
| JP | 8311945 | 11/1996 |
| JP | 2003293411 | 10/2003 |
| JP | 2006193954 | 7/2006 |
| WO | WO2008057630 | 5/2008 |
| WO | WO 2008057630 A2 * | 5/2008 |

* cited by examiner

*Primary Examiner* — Lori Baker
(74) *Attorney, Agent, or Firm* — Michael I. Kroll

(57) ABSTRACT

A touchless water control system having at least one sensor capable of determining hand movement from point A to point B in a first direction, from point C to point D in a second direction and from point E to point F in a third direction thereby establishing a spatial field spaced away from a faucet through which a user's hand can be moved to initiate or terminate water flow, water temperature and water pressure.

16 Claims, 13 Drawing Sheets

SPATIALLY REACTIVE WATER SYSTEM

BACKGROUND OF THE INVENTION

1. Field of the Invention

The present invention relates generally to controls and, more specifically, to a touchless water control system having at least one sensor capable of determining hand movement from point A to point B in a first direction, from point C to point D in a second direction and from point E to point F in a third direction thereby establishing a spatial field spaced away from a faucet through which a user's hand can be moved to initiate or terminate water flow, vary and set water temperature and water pressure.

2. Description of the Prior Art

There are other control devices designed for fluid flow. Typical of these is U.S. Pat. No. 3,556,146 issued to Groen on Jan. 19, 1971.

Another patent was issued to Pepper on Sep. 6, 1983 as U.S. Pat. No. 4,402,095. Yet another U.S. Pat. No. 4,788,998 was issued to Pepper, deceased et al. on Dec. 6, 1988 and still yet another was issued on Feb. 4, 1992 to Tsutsui et al. as U.S. Pat. No. 5,085,399.

Another patent was issued to Aharon on Aug. 27, 1996 as U.S. Pat. No. 5,549,273. Yet another U.S. Pat. No. 5,875,257 was issued to Marrin et al. on Feb. 23, 1999. Another was issued to Jeromson et al. on Feb. 4, 2003 as U.S. Pat. No. 6,513,787 and still yet another was published on May 8, 1991 to Mitsutoshi as Japan Patent No. JP3107682.

Another patent was published to Tadao, et al. on Nov. 26, 1996 as Japan Patent No. JP8311945. Yet another Japan Patent No. JP2003293411 was published to Takeshi on Oct. 15, 2003. Another was published to Yoichi et al. on Jul. 27, 2006 as Japan Patent No. JP2006193954 and still yet another was published on May 15, 2008 to Boey as International Patent Publication No. WO 2008/057630.

U.S. Pat. No. 3,556,146

Inventor: Johannes Groen

Issued: Jan. 19, 1971

A liquid dispensing device, in particular for hospitals and clinics, whereby the supply of hot or cold water to a wash bowl or the like may be controlled without touching any valves by hand. The water supply is regulated by an electromagnetic valve controlled by a proximity detector operating as a variable voltage divider. The proximity detector is fed with a high frequency signal and delivers an output voltage which may be influenced by putting the hand near the proximity detector. Separate proximity detectors for controlling the supply of hot and cold water, respectively, are mounted on the outlet pipe of the wash bowl in such manner that they may be actuated either separately or simultaneously, so that hot, cold or tepid water may be supplied as desired.

U.S. Pat. No. 4,402,095

Inventor: Robert B. Pepper

Issued: Sep. 6, 1983

A water faucet is disclosed that is automatically turned on and off in response to the proximity of the user's hand or other object to the faucet. An ultrasonic transducer is located in the faucet near the water outlet and transmits bursts of ultrasonic waves. When a wave reflects off a user's hand and creates an echo signal, the echo is detected by the ultrasonic transducer. Circuitry connected to the ultrasonic transducer determines when an object is within a predetermined distance of the faucet by measuring the time elapsed between the transmission of the burst and the reception of the echo. Once an object is within this predetermined distance, the circuitry causes a valve to open and water is supplied by the faucet.

U.S. Pat. No. 4,788,998

Inventor: Robert B. Pepper, deceased

Issued: Dec. 6, 1988

A water faucet is disclosed that is automatically turned on and off in response to the proximity of the user's hand or other object to the faucet. An ultrasonic transducer is located in the faucet near the water outlet and transmits bursts of ultrasonic waves. When a wave reflects off a user's hand and creates an echo signal, the echo is detected by the ultrasonic transducer. Circuitry connected to the ultrasonic transducer determines when an object is within a predetermined distance of the faucet by measuring the time elapsed between the transmission of the burst and the reception of the echo. Once an object is within this predetermined distance, the circuitry causes a valve to open and water is supplied by the faucet. Additionally, there is an embodiment wherein the level to which the receptacle is to be filled can be selected by the user and the fill system automatically fills the receptacle to that level. Further, there is a drain control system disclosed that causes fluid to be removed from the receptacle if the user selects an empty level or a fluid level that is lower than the fluid level of the fluid currently within the receptacle. Still further, there is a receptacle having a pilot well in communication with the main portion of the receptacle. The distance measuring sensor can be placed within the pilot well so that the rim of the receptacle exposed to the user is unencumbered.

U.S. Pat. No. 5,085,399

Inventor: Osamu Tsutsui et al.

Issued: Feb. 4, 1992

An automatically operating valve for regulating water flow, especially a mixing valve for automatically mixing hot water and cold water to obtain a mixed water of a desired temperature is characterized by employing piezoelectric actuators for operating valve bodies thereof. Due to such a construction, the valve can not only fully close or open but also carries out the fine flow amount control by regulating the opening rate or angle of the valve body. Especially in case the automatically operating valve is a mixing valve, the mixing ratio of hot water and cold water can be accurately regulated so that the mixed water of a desired temperature can be always automatically obtained.

U.S. Pat. No. 5,549,273

Inventor: Carmel Aharon

Issued: Aug. 27, 1996

An electronically operated assembly to be used in conjunction with water faucets is provided with a sensor that senses the presence of objects such as human hands and automatically starts the flow of water. The water flow automatically stops when the object is removed from the faucet vicinity. An electronically automated assembly for water faucets comprises a water flow control valve and a small size electric motor adapted to operate the water flow control valve via a transmission gear and an infrared sensing device connected to a source of electric power adapted to activate or disconnect the electric motor.

U.S. Pat. No. 5,875,257

Inventor: Teresa Marrin et al.

Issued: Feb. 23, 1999

Apparatus for continuous sensing of hand and arm gestures comprises hand-held means for continuously sensing at least tempo and emphasis. These sensed parameters are represented quantitatively, and transduced by appropriate circuitry into electrical signals indicative of the parameter quantities. The signals may be used to control the performance of a musical composition (or the evolution of some other dynamic system), or may instead convey information. The signals may, for example, be provided to an interpreter that dynamically infers control commands from the gestures on a real-time basis in accordance with the generally accepted canon of musical conducting, directing the controlled system in accordance therewith. The invention may also sense one or more additional conducting parameters such as the speed and/or velocity, direction (i.e., trajectory) in three dimensions, absolute three-dimensional position, the "size" of a gesture in terms of the spatial distance between successive beats, and the "placement" of a beat pattern in space.

U.S. Pat. No. 6,513,787

Inventor: Peter James Jeromson et al.

Issued: Feb. 4, 2003

The fluid supply apparatus supplies and controls one or more fluids while adjusting/controlling one or more continuously parameters; and includes an outlet, at least one control valve and a touchless user control interface. For example a faucet has sensors mounted thereon to control water flow (6) and temperature (16, 17). For example a user hand in field (16) will increase temperature over time and decrease in field (17). The on/off sensor field may include the water stream, a bi-colour light emitting diode indicates temperature, temperature feedback means maintains the desired temperature, a battery or super capacitor allows operation or fluid shut off if power fails, an anti-tamper feature requires the fluid to be shut off if more than one sensor is covered and a time prevents waster wastage. The hygienic touchless interface may be in a tile or flat plate. Other applications may include panel mounted fluid control systems for controlling a plurality of fluid types and associated parameters.

Japan Patent Number JP3107682

Inventor: Kimura Mitsutoshi

Published: May 8, 1991

PURPOSE: To regularly and certainly operate a device without a possibility of improper operation by a foreign material by providing first to third opening and closing means for opening and closing a solenoid valve, depending on the distance detected by a distance sensor in a valve control means. CONSTITUTION: When a user goes in front of a sink 14 and reaches out his hand just before a distance sensor 21 (a position closer to the sensor 21 than a first distance), a first opening and closing means 1 operates to open a solenoid valve 13, so that water or hot water is released from a faucet 12. When the user again reaches out the hand just before the sensor 21, a second opening and closing means 2 operates to close the valve 13. The valve 13 is alternately opened and closed every time when the hand is consciously reached out just before the sensor 21, and the release and stop of water from the faucet 12 are repeated. When the user leaves the sink 14 during release of water, a third opening and closing means 3 operates to close the valve 13, so that the release of water is stopped. When a foreign material passes just before the sensor 21 in the absence of the user, the means 1 detects this to open the valve 13, but after the foreign material passed, the means 3 operates to close the valve 13.

Japan Patent Number JP8311945

Inventor: Soma Tadao et al.

Published: Nov. 26, 1996

PURPOSE: To make it possible to inject water at the position of a hand with accuracy by laying out a sensor which detects light at the tip of an arm member which follows a rotary movement of a faucet and bringing a hand near a water outlet so as to pass water and separating the hand from the outlet so as to stop the flow of water. CONSTITUTION: The length dimensions of a faucet 12 and an optical detection sensor 20 are arranged with an optical detection member 19 by expanding and contracting the arm. The arm member 19 is turned, centering on a mounting shaft 22 of the arm member 19. The positional arrangement of the sensor 20 is made so as to set that the sensor come to the tip of the faucet 12. As descried above, fingers are held out to the tip of the faucet 12 on a washstand. When the sensor 20 detects this, a faucet drive mechanism 15 makes a closing motion so that tap water may flow out from a water outlet 13. Then, the fingers are pulled in after cleaning and the faucet drive mechanism 15 makes a closing motion by way of the sensor 20, thereby halting the flow of water. When the faucet 12 is interrupting, the faucet 12 is turned to a corner, thereby securing an upper space. The faucet 12 and the optical detection sensor 20 are turned in one piece motion by mounting a connection member 2 and both members 12 and 20 may be independently turnable respectively.

Japan Patent Number JP2003293411

Inventor: Sugimoto Takeshi

Published: Oct. 15, 2003

PROBLEM TO BE SOLVED: To provide a water supply control device, enabling reduction of wrong sensing due to detection of others than the hand and detection of the hand during washing work during the operation of a rotary handle or a lever handle of a water faucet and to provide a water supply control device, preventing an increase in size of a top part of a spout, not impairing the appearance of the spout, and having good design. SOLUTION: This water supply control device has a capacitance detecting type sensor used as a detecting part having a human body detecting means, and includes an opening and closing valve unit for opening and closing a passage according to the input from the detecting part, a controller for controlling the opening and closing valve unit, and a discharge part for discharging liquid supplied by the opening and closing valve unit. As a detecting means of the capacitance detecting type sensor, a detecting electrode is exposed on the detecting surface.

Japan Patent Number JP2006193954

Inventor: Murase Yoichi et al.

Published: Jul. 27, 2006

PROBLEM TO BE SOLVED: To provide an automatic water-discharge controller capable of making precise water-discharge control by corresponding to the movement such as a forward movement of a hand to the water-discharge controller, a hand washing and a backward movement of the hand or the like of a user in the water discharge controller making use of an object sensor. SOLUTION: When water is not discharged, the first electromagnetic wave beam 23 is emitted to the first direction facilitating the detection of the forward movement of the hand 10 from a microwave motion-body sensor 22. When the forward movement of the hand 10 is detected by the first electromagnetic wave 23, the water discharge starts and, at the same time, the second electromagnetic wave beam 31 is emitted to the second direction facilitating the detection of the movement of scattering water 34 during the hand washing and having difficulty in making detection of a stream 30 naturally flowing out from a faucet 21. When the movement of the scattering water 34 can't be detected by the second electromagnetic wave beam 31, the water discharge stops.

International Patent Publication Number WO 2008/057630

Inventor: Kum Foong Boey

Published: May 15, 2008

A faucet control system comprises a valve apparatus, sensors or a touch panel to be activated by a user, and a controller that controls the valve apparatus. A first sensor may start fluid flow and a second sensor may alter the proportion of fluids delivered from two fluid sources. The sensors may be activated without being touched and may include infrared sensing elements. The touch panel may be activated with hand pressure and may include electrically conductive sheets. The touch panel may have a first portion for allowing fluid flow from a first fluid source, a second portion for allowing fluid flow from the first fluid source and a second fluid source, and a third portion for allowing fluid flow from the second fluid source. The controller may include an adjustable timer so that fluid flow can be stopped automatically after a selected period of time.

While these controls may be suitable for the purposes for which they were designed, they would not be as suitable for the purposes of the present invention, as hereinafter described.

SUMMARY OF THE PRESENT INVENTION

A primary object of the present invention is to provide a touchless water control system.

Another object of the present invention is to provide a touchless water control system for starting water flow from a faucet.

Yet another object of the present invention is to provide a touchless water control system for stopping water flow from a faucet.

Still yet another object of the present invention is to provide a touchless water control system for varying water temperature from a faucet.

An additional object of the present invention is to provide a touchless water control system for varying water pressure from a faucet.

A further object of the present invention is to provide a touchless water control system having at least one sensor spaced away from said faucet.

A yet further object of the present invention is to provide a touchless water control system wherein hand articulation relative to said one sensor enables control over the temperature and pressure dispensed from a faucet.

A still yet further object of the present invention is to provide a touchless water control system having at least two sensors spaced away from said faucet.

Another object of the present invention is to provide a touchless water control system wherein hand articulation relative to said two sensors enables control over the temperature and pressure of the water dispensed from a faucet.

Yet another object of the present invention is to provide a touchless water control system having at least two sensors spaced away from said faucet and angularly disposed to each other.

Still yet another object of the present invention is to provide a touchless water control system wherein hand articulation in both direction and time may control on and off of the water, temperature of the water and pressure of the water.

An additional object of the present invention is to provide a touchless water control system wherein tapping proximate the sensor turns the water on or off.

A further object of the present invention is to provide a touchless water control system wherein stationary objects within the sensor field does not affect the sensor(s).

A yet further object of the present invention is to provide a touchless water control system having sensors selected from the group of infrared, sonic and capacitance.

A still further object of the present invention is to provide a touchless water control system that is programmable to a desired set of functions.

Another object of the present invention is to provide a touchless water control system that can be selectively programmed wirelessly.

Additional objects of the present invention will appear as the description proceeds.

The present invention overcomes the shortcomings of the prior art by providing a touchless water control system having at least one sensor capable of determining hand movement and time in a first direction, hand movement and time in a second direction and hand movement and time in a third direction thereby establishing a spatial field spaced away from a faucet through which a user=s hand can be moved to initiate or terminate water flow, water temperature and water pressure.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
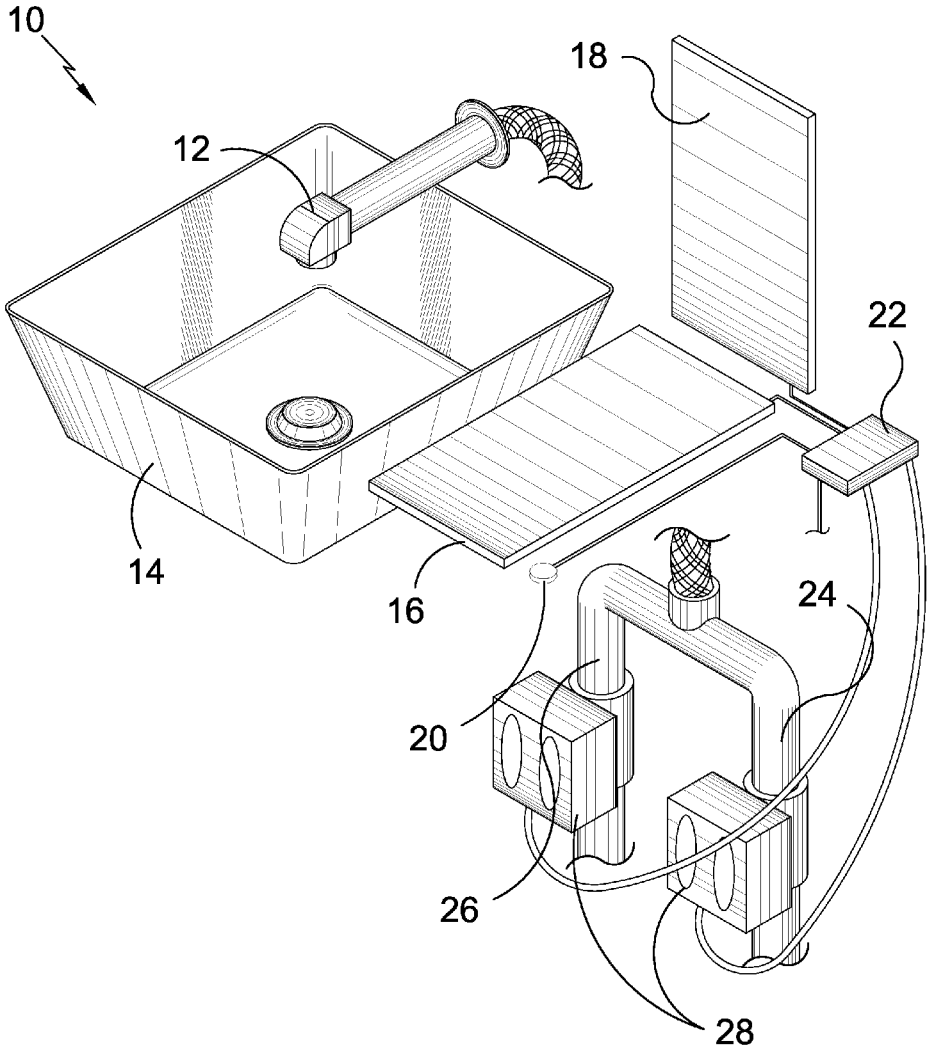
FIG. 1 is an illustrative perspective view of the present invention.

Turning now descriptively to the drawings, in which similar reference characters denote similar elements throughout the several views, the Figures illustrate the Spatially Reactive Water System of the present invention. With regard to the reference numerals used, the following numbering is used throughout the various drawing figures.

10 Spatially Reactive Fluid Control System of the present invention
12 faucet
14 sink
16 horizontal sensor
18 vertical sensor
20 moisture sensor
22 CPU
24 hot water
26 cold water
28 regulatory valves
30 back splash
32 water amount (pressure)
34 hot/cold (temperature)
36 user's hand
38 "X" displacement
40 "Y" displacement
42 "Z" displacement
44 lower pressure
46 raise pressure
48 decrease temperature
50 increase temperature
52 sweeping side motion
54 coplanar spaced apart sensors
56 left/right mixes hot and cold temperature
58 to solenoids and water supply
60 hand passing in any direction
62 single sensor
64 tap movement
66 height level
68 fluid source
70 to fluid outlet
72 programmable microprocessor
74 visual indicators

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative perspective view of the present invention 10. Typically when using a sink 14 there is provided at least one valve for initiating water flow, intensity of water flow, temperature of water being dispensed and water shut-off. All of which are controllable through use of the touchless control system of the present invention, which incorporates a pair of sensors 16, 18 in electrical communication with actuators creating a three dimensional zone through which an operator moves their hand to control selection of the aforementioned functions typically controlled through proportion valves. The present invention's 10 control over a sink's 14 faucet 12 is determined by locational interpretation of the user's hand relative to a pair of perpendicularly disposed sensors 16, 18 having associated regulatory valves 28 for hot 24 and cold 26 lines that work in unison to determine the user's relative position to the sensors 16, 18 thereby controlling the turning on and off of water, setting of temperature and the amount of water pressure desired by the user.

Figure 2:
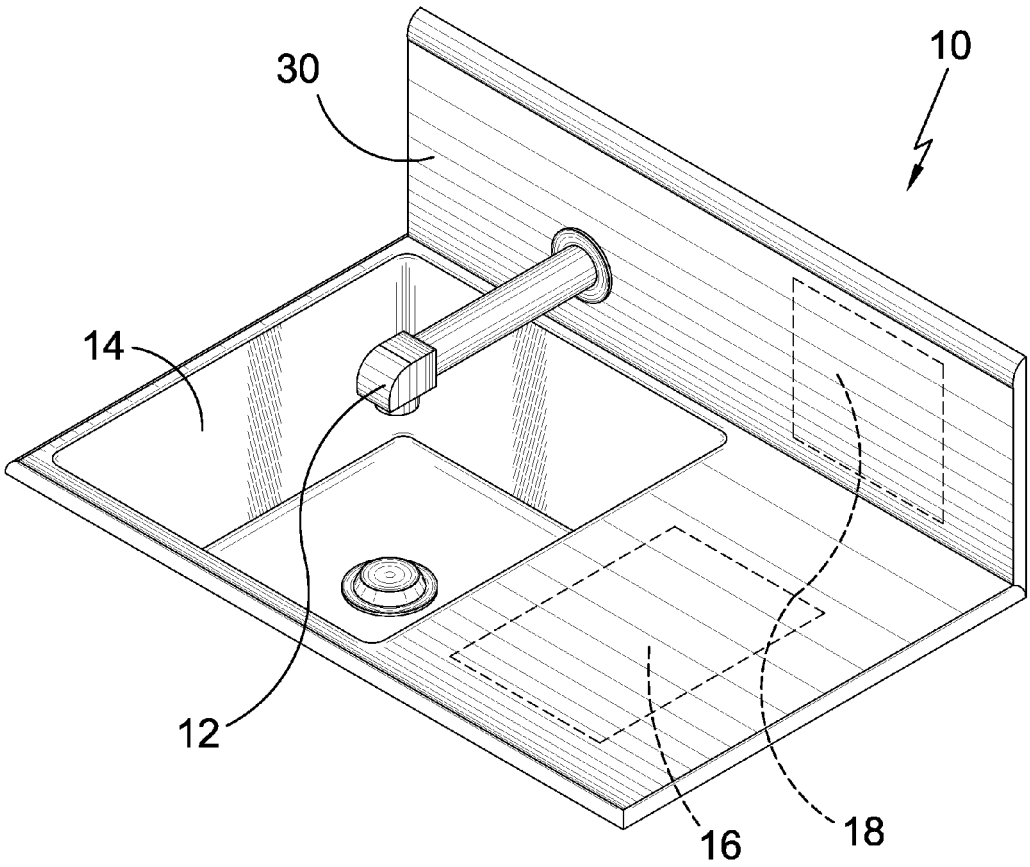
FIG. 2 is an illustrative view of the present invention.

Referring to FIG. 2, shown is an illustrative view of the present invention 10. The present invention 10 is a fluid dispensing control system for varying temperature and pressure at an outlet, such as a faucet 12. Illustrated is one example of the present invention 10 where temperature and pressure are programmable regulated through locational interpretation of the user's hand relative to a pair of perpendicularly disposed motion sensors 16, 18. When installed the present invention's sensors 16, 18 are visible or invisible to the human eye and utilize wave inference as a sensing medium. Utilizing this embodiment of the touchless system creates a more hygienic environment.

Figure 3:
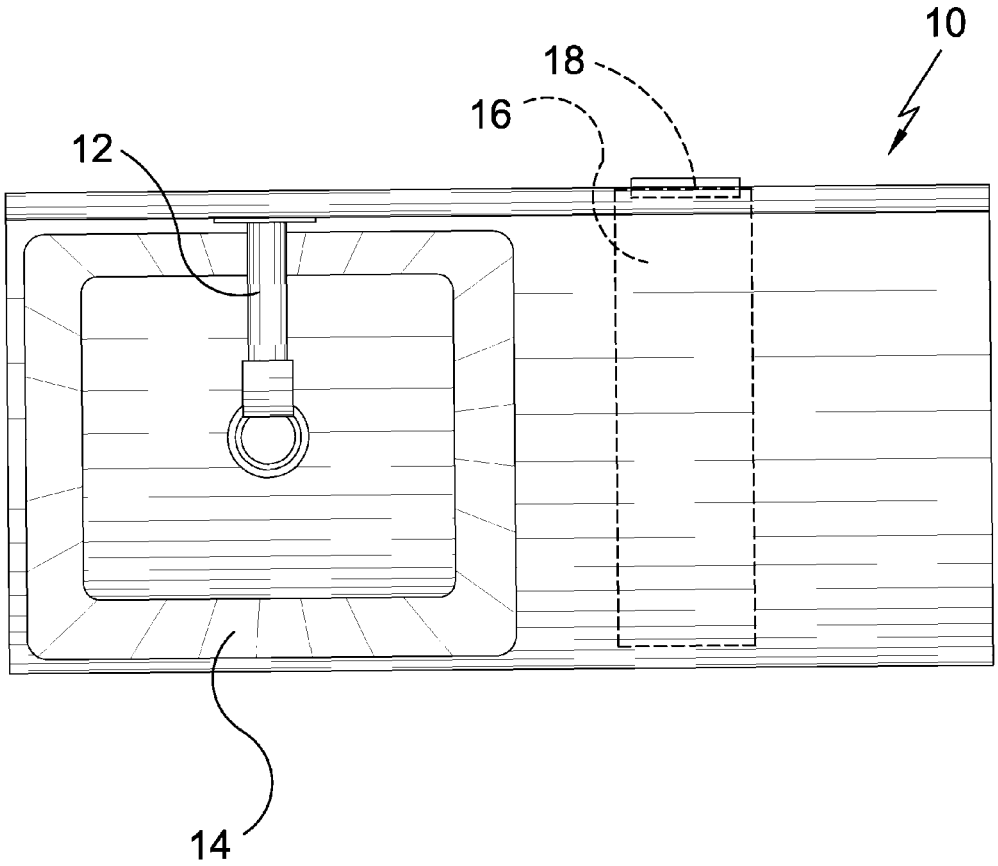
FIG. 3 is a top view of the present invention.

Referring to FIG. 3, shown is a top view of the present invention 10. Shown is a top view of the present invention 10 depicting how an area is set aside in the sink's 14 counter and back splash 30 for placement of both the vertical 18 and horizontal 16 sensing panels.

Figure 4:
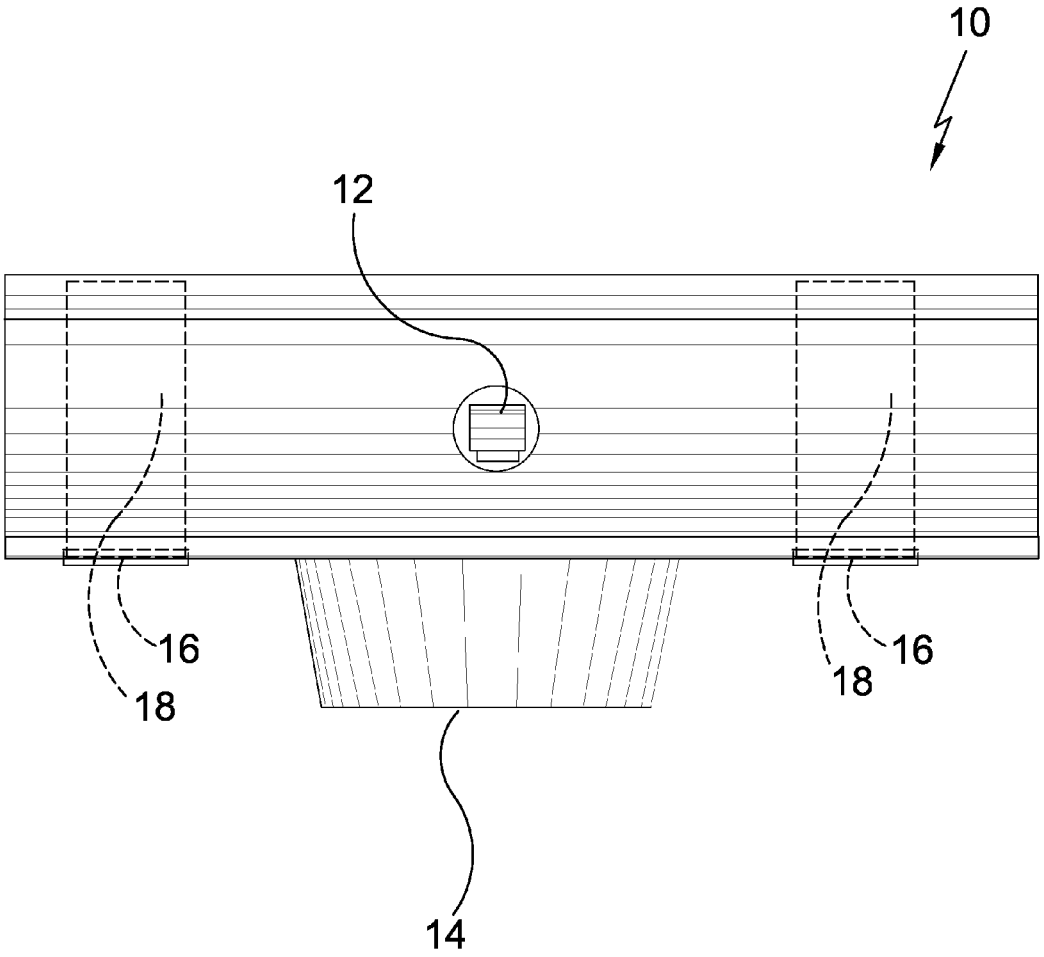
FIG. 4 is a front view of the present invention.

Referring to FIG. 4, shown is a front view of the present invention 10. Shown is a front view of the present invention 10 depicting an area set aside in the sink's 14 back splash and counter top for placement of both the vertical 18 and horizontal 16 sensing panels on either side or both sides of the dispensing faucet 12. In which case left or right (sensor set) can be activated by entering the field at that point the other side will become inactive for that use.

Figure 5:
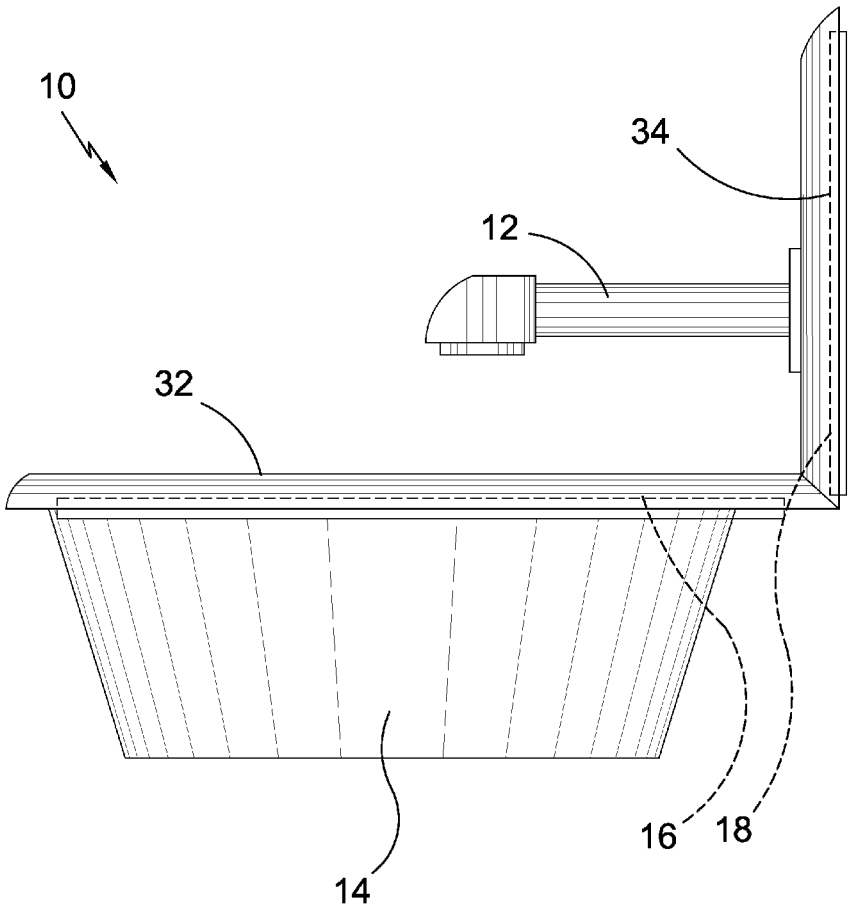
FIG. 5 is a side view of the present invention.

Referring to FIG. 5, shown is a side view of the present invention 10. Shown is a side view of the present invention 10 depicting the arrangement of the vertical 18 and horizontal 16 sensors in relation to each other. The vertical sensor 18 senses up and down movement while the horizontal sensor 16 senses forward and backward motion. The sensors are depicted in a specific configuration for illustrative purposes to control water amount (pressure) 32 and hot or cold (temperature) 34 with their actual location more of a desired design aesthetics.

Figure 6:
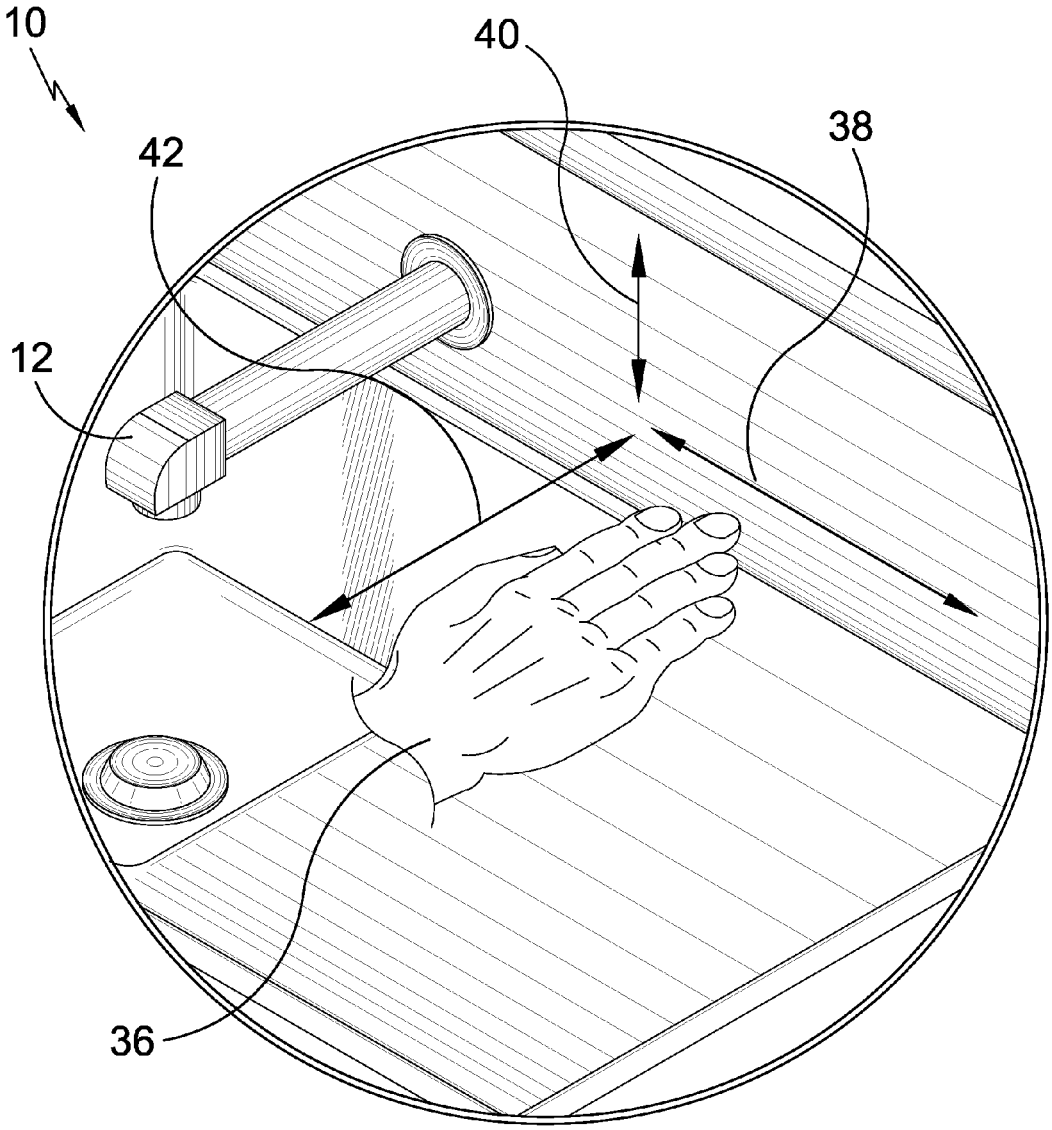
FIG. 6 is a perspective illustrative view of the present invention in use.

Referring to FIG. 6, shown is a perspective illustrative view of the present invention 10 in use. Shown is the user's hand held over the sensing area of the present invention, movement of the user's hand 36 about the three axis of a three dimensional plane each determine a different function for the sink 14 to perform. Movement up and down the "Y" plane 40 controls the sinks 14 pressure, movement in forward and back on the "Z" plane 42 determines a hotter or colder temperature and movement in the "X" direction 38 enters a setting or command to turn off the faucet 12.

Figure 7:
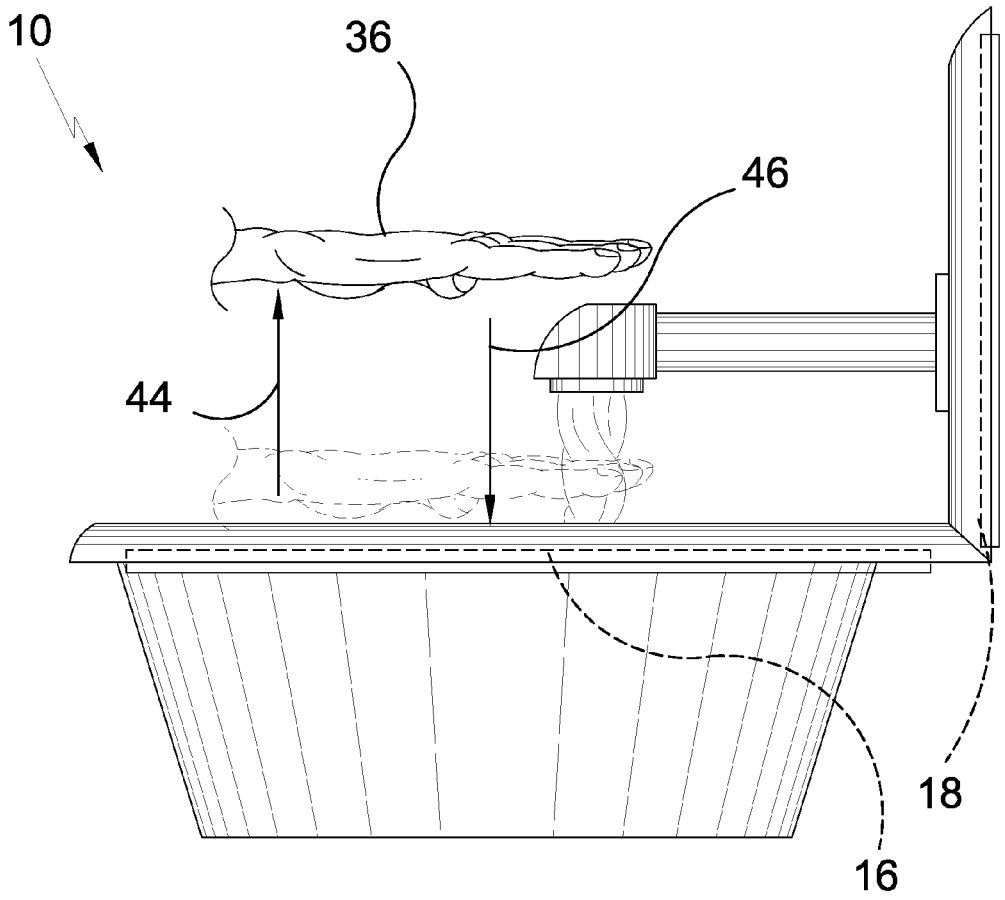
FIG. 7 is a side view of the present invention in use.

Referring to FIG. 7, shown is a side view of the present invention 10 in use. Shown is how when the user raises or lowers their hand 36 the water pressure is changed respectively 44, 46. In order to lower the water pressure 44 the user raises their hand, in order to raise the pressure 46 the user lowers their hand. To turn off the water the user pulls their hand away, sweeps hand through field or taps counter top. However different off methods can be changed depending on user specification.

Figure 8:
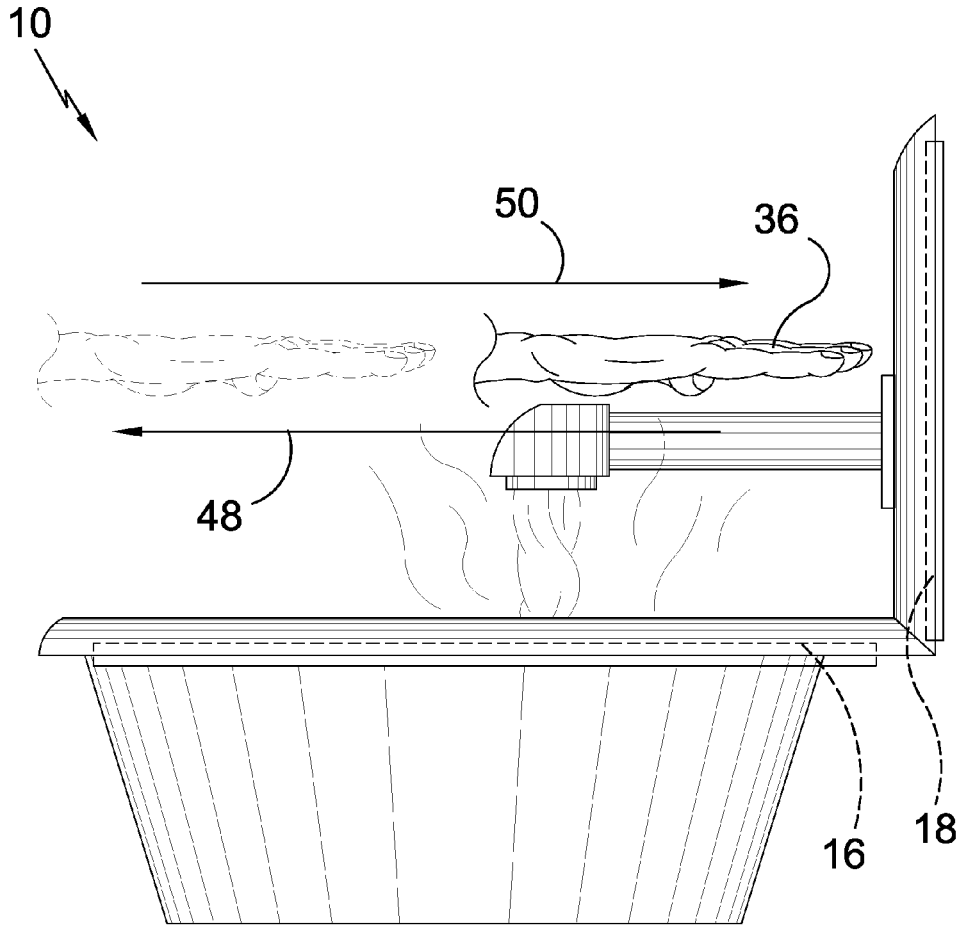
FIG. 8 is a side view of the present invention in use.

Referring to FIG. 8, shown is a side view of the present invention 10 in use. Shown is how when the user advances or retracts their hand 36 the water temperature is changed respectively 48, 50. In order to increase the water temperature 50 the user advances their hand, in order to lower the temperature 48 the user retracts their hand. When a desired setting is met the user sweeps their hand away to the side.

Figure 9:
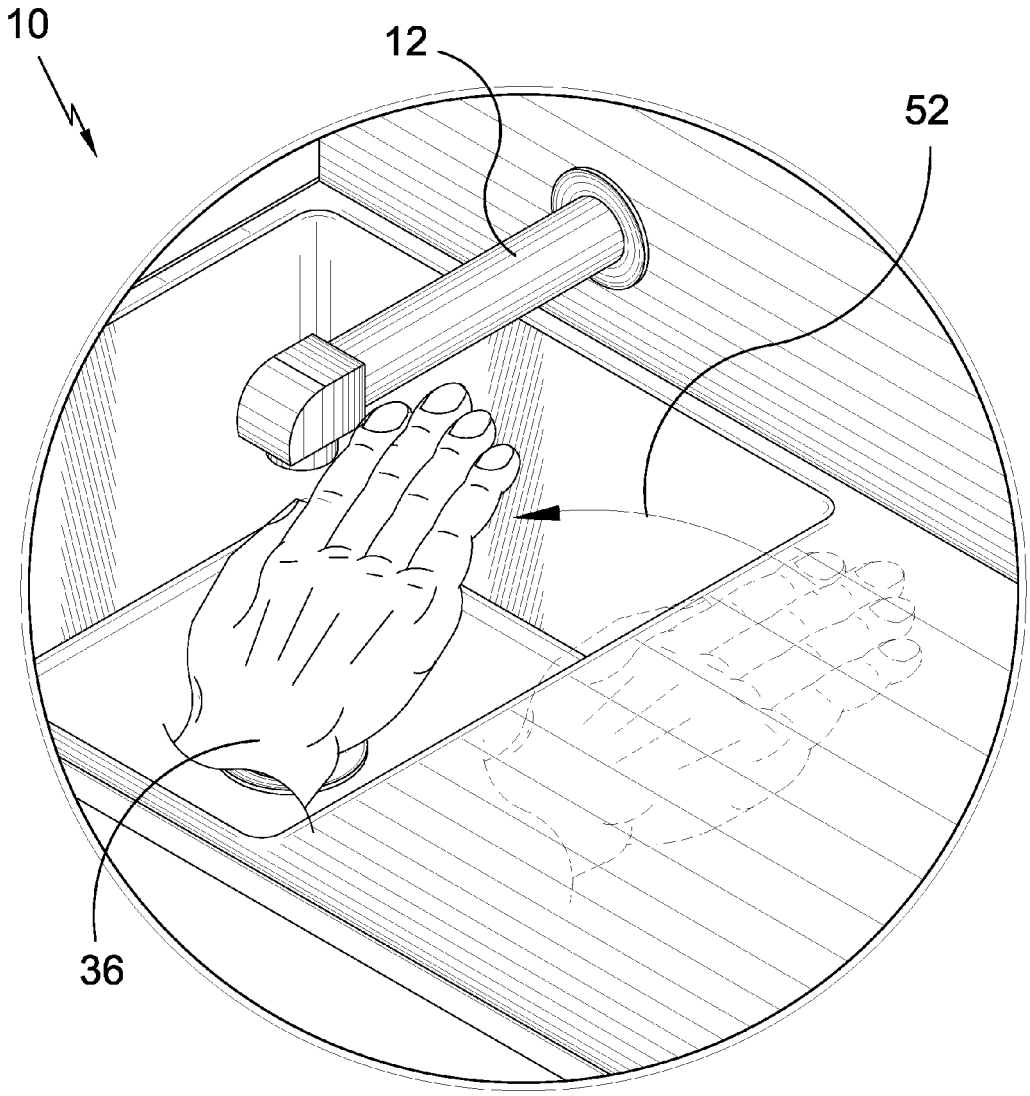
FIG. 9 is a perspective illustrative view of the present invention.

Referring to FIG. 9, shown is a perspective illustrative view of the present invention 10. Shown is the manner by which the user can decide on a preferred setting. After a preferred setting is reached the user can maintain said setting by simply sweeping their hand 36 horizontally 52 to either side. Turning off the device is achieved by touching the bottom sensor or sweeping hand across field 52 or pulling hand away from sensors.

Figure 10:
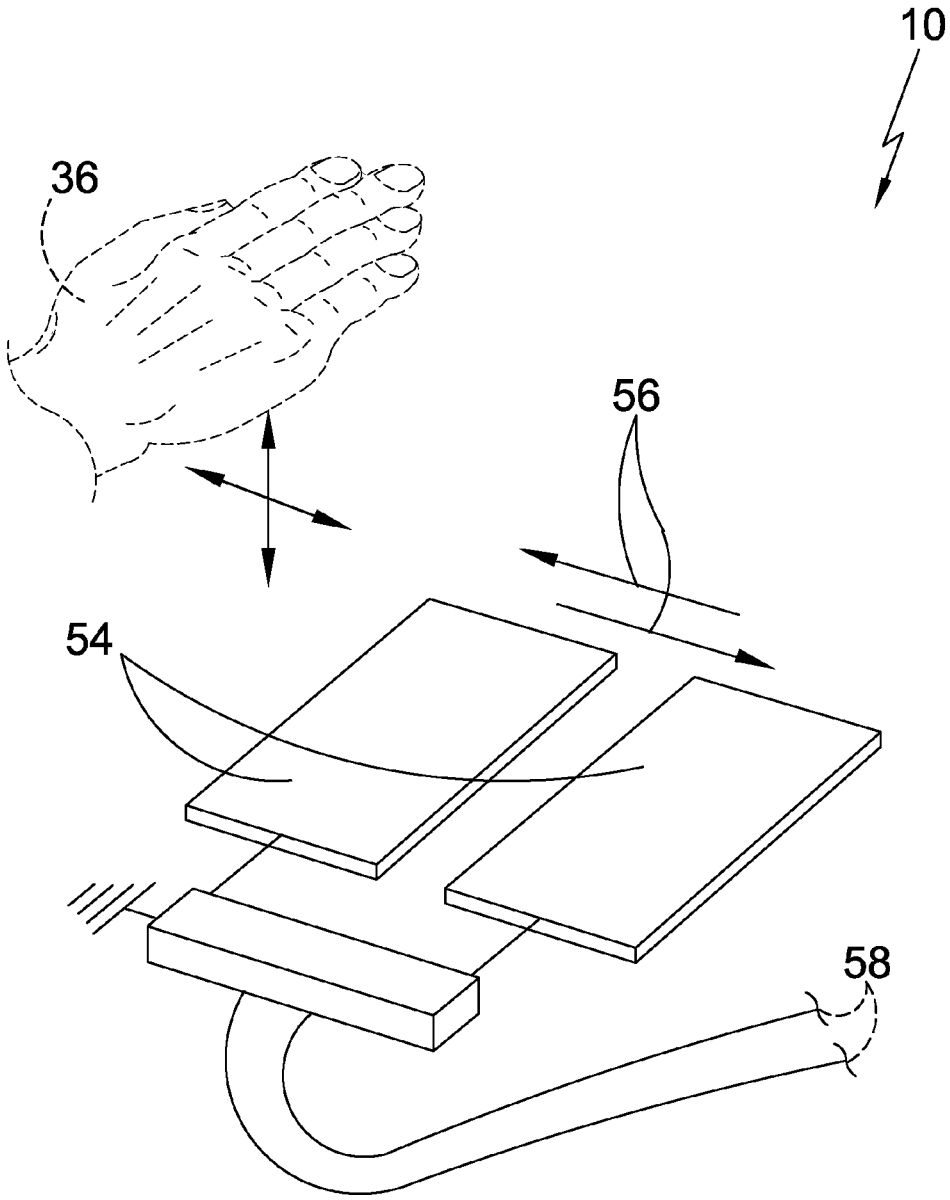
FIG. 10 is a perspective illustrative view of the present invention in use.

Referring to FIG. 10, shown is a perspective illustrative view of the present invention 10 in use. Shown is the user's hand held 36 over a pair of coplanar spaced apart sensors 54 comprising the sensing area, each sensor sensing movement in one direction causes a pressure change independent from the other while movement through another direction 56 causes mixing of the hot and cold water to a desired temperature.

Figure 11:
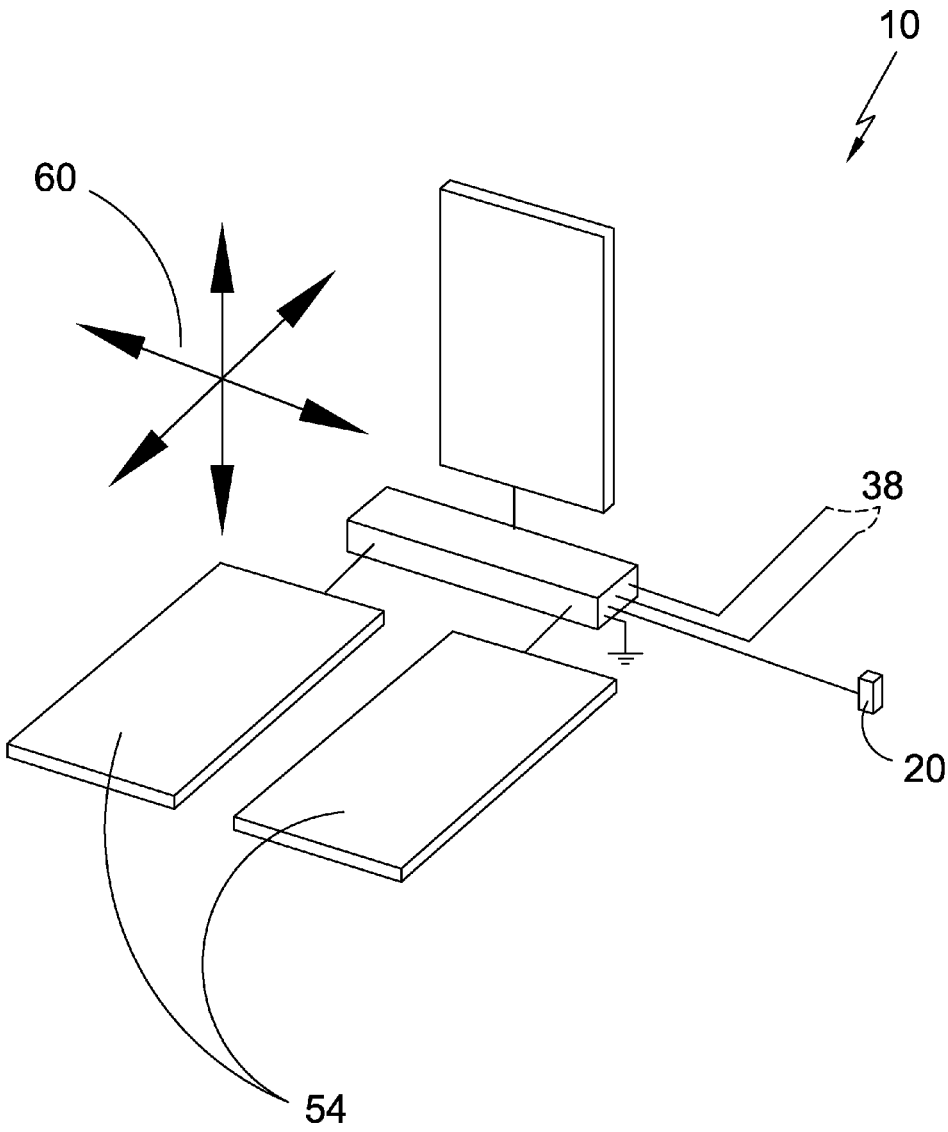
FIG. 11 is a perspective illustrative view of the present invention.

Referring to FIG. 11, shown is a perspective illustrative view of the present invention 10. Shown is at least one sensor for controlling a fluid flow through a faucet by passing a hand through a sensor defined field through any direction 60 that may also include time duration for initiating and terminating fluid flow and for controlling temperature and pressure of the flow. Also shown is a moisture sensor 20 which allows the system to compensate for moisture levels in air and surfaces.

Figure 12:
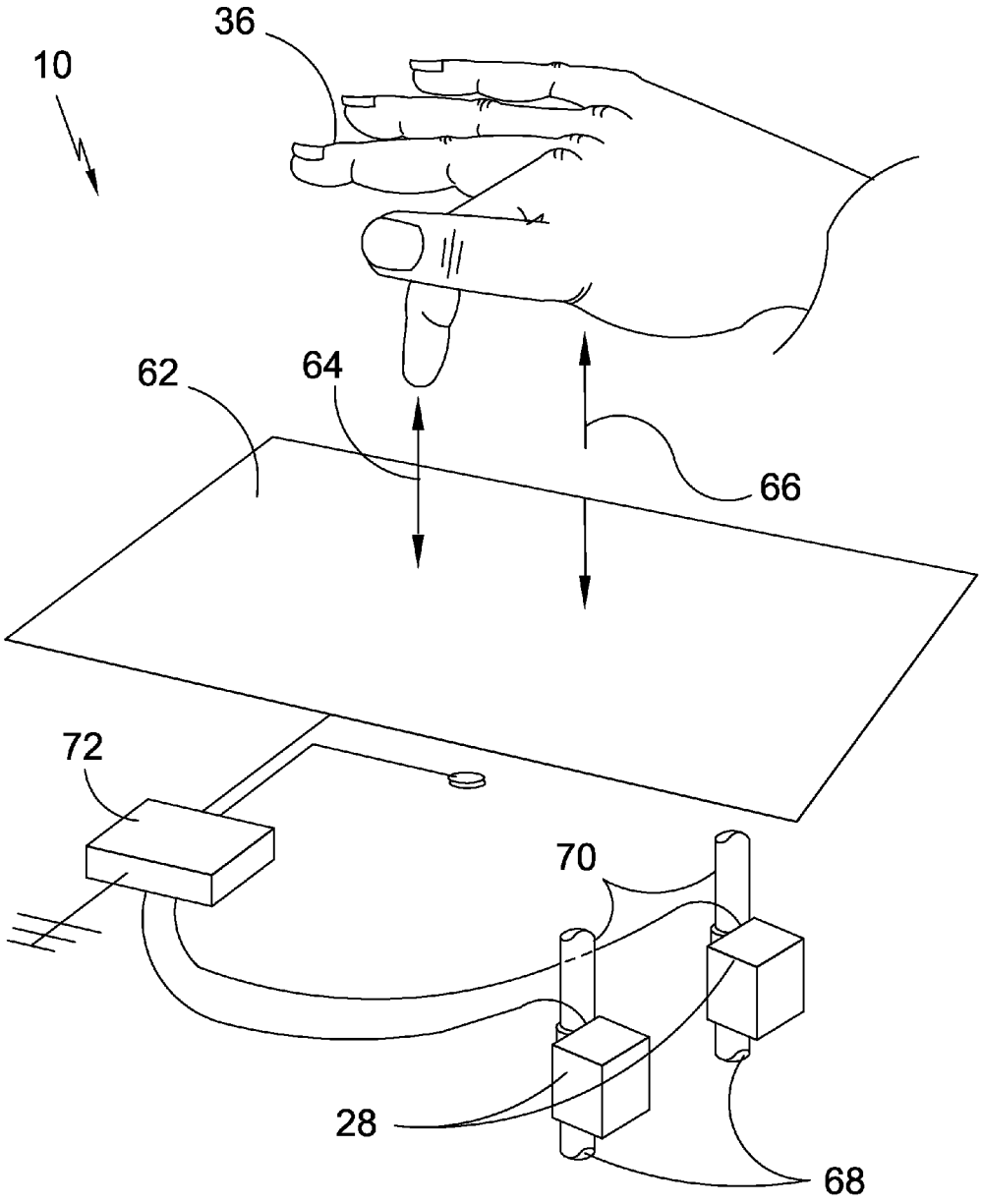
FIG. 12 is a perspective illustrative view of the present invention in use.

Referring to FIG. 12, shown is a perspective illustrative view of the present invention 10 in use. Shown is the user's hand 36 held over the single sensor 62 that will control temperature and pressure through the number of taps 64 upon the sensor 62 and the duration between the taps 64. Additional adjustment for pressure or hot and cold water can be made utilizing a combination of taps 64 for one setting and height adjustment for the other.

Figure 13:
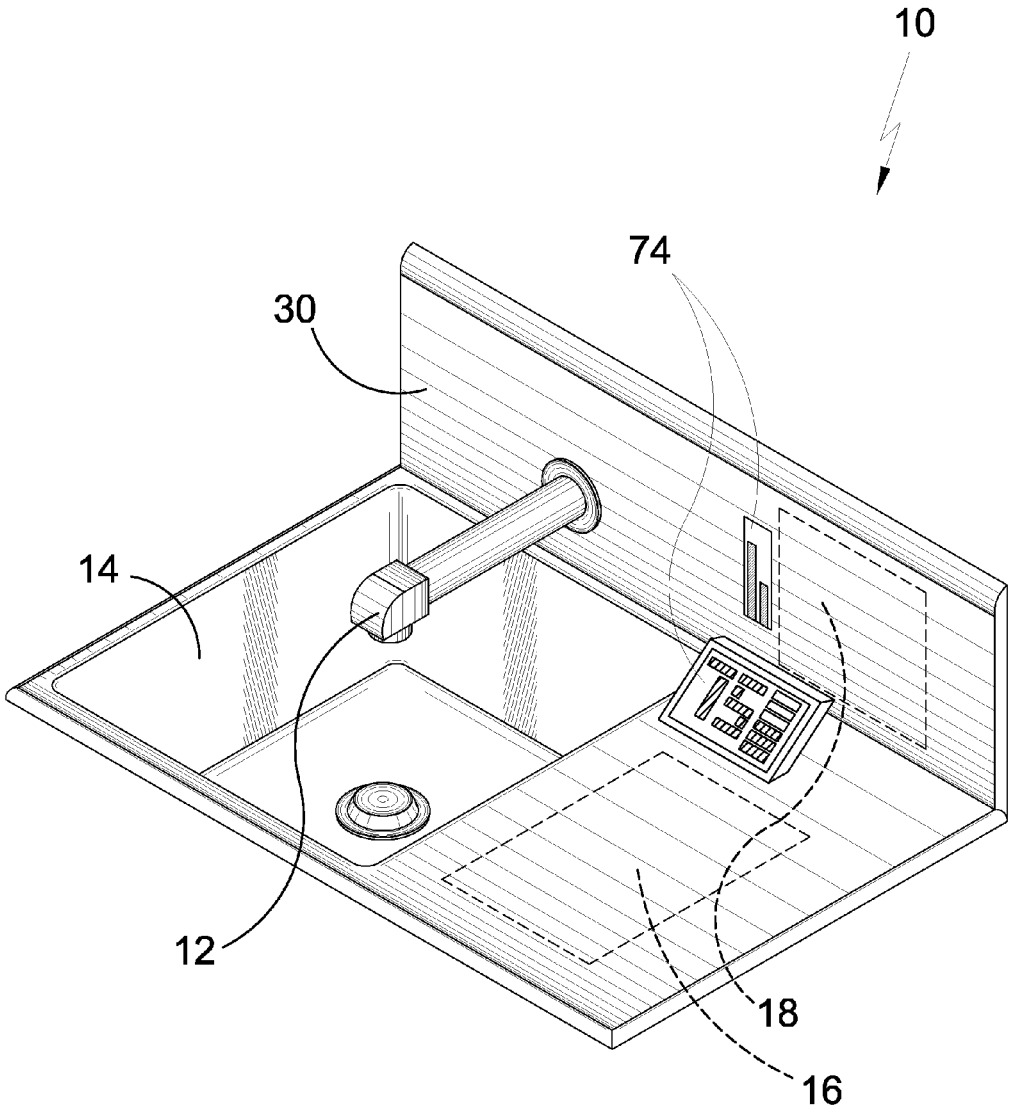
FIG. 13 is an illustrative view of an additional element of the present invention.

Referring to FIG. 13, shown is an illustrative view of an additional element of the present invention 10. Shown is the present invention 10 having a plurality of optional visual indicator displays 74 whereby the temperature or pressure of the water may be presented to the user visually by either graphics, bars, charts or numerically.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A spatially reactive water system comprising:

a) a sink with a water supply conduit having an outlet in fluid communication with a water source, said sink being mounted in a counter with a back splash;

b) a power supply;

c) vertical and horizontal deployed sensors, placed perpendicular to each other adjacent said sink within said backsplash and counter top, respectively, creating a three dimensional zone for detecting a user's hand movement within said zone, said vertical sensor for sensing up and down movement of the hand, said horizontal sensor for sensing forward and back movement of the hand, for generating a variable signal in response to the positioning of the user's hand within said zone for initiating water flow, controlling intensity of water flow, temperature of water being dispensed, and water shut-off; and d) a solenoid controlled valve interdisposed between said water outlet and said water source controllable by said sensor signal to move a conduit valve between a fully open state to a fully closed state or any portion therebetween.

2. A spatially reactive water system according to claim 1, wherein said sensor is selected from the group consisting of ultrasonic, capacitance, and sonic.

3. A spatially reactive water system according to claim 2, wherein said water control is determined by locational interpretation of user's hands relative to said perpendicularly placed sensors.

4. A spatially reactive water system according to claim 3, wherein said perpendicularly placed sensors comprises at least one vertical sensor for the purpose of sensing up and down user hand motion and at least one horizontal sensor for the purpose of sensing forward and backward motion.

5. A spatially reactive water system according to claim 4, wherein said positioning of user's hands relating to temperature and pressure are programmable through said locational interpretation.

6. A spatially reactive water system according to claim 1, wherein said sensors utilize wave inferences as a sensing medium.

7. A spatially reactive water system according to claim 5, wherein said sensors are located within said sink counter top and back splash on either side or both sides of a dispensing faucet.

8. A spatially reactive water system according to claim 7, having a left or right sensor set of said sensors on both sides of said dispensing faucet activated by entering the field at that point causing the unused side to become inactive for that use.

9. A spatially reactive water system according to claim 8, wherein movement up and down on a "Y" plane controls said sink water pressure.

10. A spatially reactive water system according to claim 9, wherein movement forward and back on a "Z" plane controls said water temperature.

11. A spatially reactive water system according to claim 10, wherein movement in one direction on an "X" plane enters a command to turn off said faucet.

12. A spatially reactive water system according to claim 11, wherein water pressure is lowered by raising said user's hand and water pressure is raised by lowering said user's hand.

13. A spatially reactive water system according to claim 1, wherein said sensors are coplanar spaced apart sensors.

14. A spatially reactive water system according to claim 13, wherein movement in one direction causes pressure change and movement in another direction causes mixing of hot and cold water to causes temperature change.

15. A spatially reactive water system according to claim 14, wherein hand taps on a sensor, either single taps or in combination, controls said water pressure and said water temperature.

16. A spatially reactive water system according to claim 1, further comprising a plurality of visual indicator displays which presents said water pressure and said water temperature visually using graphics, bars, charts or numerically.

* * * * *